US007086209B1

(12) United States Patent
Pruitt et al.

(10) Patent No.: US 7,086,209 B1
(45) Date of Patent: Aug. 8, 2006

(54) METHOD FOR CONSTRUCTING A BUILDING AND RESULTING BUILDING

(75) Inventors: Richard A. Pruitt, Orlando, FL (US); Dennis K. Towell, Orlando, FL (US)

(73) Assignee: Nelson, L.C., Sanford, FL (US)

( * ) Notice: Subject to any disclaimer, the term of this patent is extended or adjusted under 35 U.S.C. 154(b) by 329 days.

(21) Appl. No.: 10/096,011

(22) Filed: Mar. 11, 2002

Related U.S. Application Data

(60) Provisional application No. 60/274,890, filed on Mar. 9, 2001.

(51) Int. Cl.
*E04G 21/00* (2006.01)

(52) U.S. Cl. ..... 52/745.13; 52/79.7; 52/79.9; 52/125.1

(58) Field of Classification Search ..... 52/745.1, 52/741.1, 745.2, 742.14, 169.12, 79.7, 79.5, 52/127.2, 299, 106, 169.9, 92.1, 639, 62, 52/143, 745.13, 79.9, 125.1, 125.5, 272, 52/274, 6; 520/79.1
See application file for complete search history.

(56) References Cited

U.S. PATENT DOCUMENTS 1,156,693 A * 10/1915 Kroger ..... 296/26.01
2,673,459 A * 3/1954 Overhulse ..... 52/259
2,706,313 A * 4/1955 Radman ..... 52/79.9
3,442,056 A * 5/1969 Van Der lely et al. ..... 52/79.7
3,605,350 A * 9/1971 Bowers ..... 52/16
3,834,110 A * 9/1974 Vercelletto ..... 52/745.02
4,222,208 A * 9/1980 Ferver ..... 52/169.5
4,327,529 A * 5/1982 Bigelow et al. ..... 52/34
4,501,098 A * 2/1985 Gregory ..... 52/79.1
4,512,120 A * 4/1985 Lindal ..... 52/79.1
4,512,126 A * 4/1985 Walston ..... 52/251
4,546,530 A * 10/1985 Rizk ..... 29/430
4,644,708 A * 2/1987 Baudot et al. ..... 52/79.9
4,731,964 A * 3/1988 Phillips ..... 52/106
4,854,094 A * 8/1989 Clark ..... 52/79.1
5,313,753 A 5/1994 Sanger
5,353,558 A * 10/1994 Shea et al. ..... 52/143
5,381,635 A 1/1995 Sanger
5,425,207 A * 6/1995 Shayman ..... 52/79.9
5,678,372 A * 10/1997 Thomson et al. ..... 52/432
6,035,583 A * 3/2000 Papke ..... 52/79.1
6,038,824 A * 3/2000 Hamrick, Sr. ..... 52/143
6,195,950 B1 * 3/2001 Harris ..... 52/270
6,272,810 B1 * 8/2001 Ingram et al. ..... 52/742.14
6,286,269 B1 * 9/2001 Marcum ..... 52/79.5
6,493,996 B1 * 12/2002 Alexander et al. ..... 52/79.9
6,983,567 B1 * 1/2006 Ciotti ..... 52/79.5

FOREIGN PATENT DOCUMENTS

FR 2753468 * 12/1998

* cited by examiner

*Primary Examiner*—Naoko Slack
(74) *Attorney, Agent, or Firm*—Saliwanchik Lloyd & Saliwanchik

(57) ABSTRACT

The subject invention pertains to a method for constructing, transporting and erecting buildings. The subject invention also relates to buildings which can be transported and erected at a desired site. Advantageously, a specific embodiment of the subject invention can be relocatable. The subject invention is advantageous in situations where an individual or group, such as a school system or construction company, needs temporary, portable buildings which can easily be constructed and broken down for transportation to a new site. In a specific embodiment, the subject method utilizes durable construction materials to comply with building codes and withstand the rigors of years of service in a variety of environmental conditions in addition to providing rapid construction and relocation benefits.

24 Claims, 14 Drawing Sheets

METHOD FOR CONSTRUCTING A BUILDING AND RESULTING BUILDING

CROSS-REFERENCE TO A RELATED APPLICATION

The present application claims the benefit of U.S. Provisional Application No. 60/274,890, filed Mar. 9, 2001.

BACKGROUND OF THE INVENTION

Relocatable buildings have many wide ranging applications. Buildings of this type can be used to provide temporary and/or low cost shelter. In addition, the use of relocatable buildings can reduce the period of time necessary to erect a desired building. Relocatable buildings can be used by, for example, school systems as classroom buildings or on construction sites as temporary offices.

In addition to providing useful temporary shelter, relocatable buildings can be employed to solve long term needs of customers. School systems, for example, can purchase several relocatable buildings to aid with population booms within the system. In a school system, a certain district may have an overpopulation of elementary school students. The school system can place one or more relocatable buildings at the elementary schools with too many students. When the elementary school students move on to middle school, the school system can then relocate the buildings to the middle school in order to "follow the boom" of students. In this fashion, a school system can manage periodic shifts in populations without resorting to expensive, permanent school building renovation or expansion.

Due to the possibility that an individual or group may employ a relocatable building for an extended period of time, relocatable buildings preferably have a long life span and are of sturdy construction. Furthermore, certain applications necessitate additional performance criteria for the buildings. Also, certain jurisdictions may have building codes dealing with relocatable buildings, such as the ability to withstand high winds. Other considerations such as insulative properties, environmental impact, and weatherproofness influence the construction of relocatable buildings.

Traditional methods of constructing relocatable buildings include prefabricating portions of the building, transporting the portions to the construction site and puffing the building together from the ground up. These traditional methods tend to be time consuming and require extensive labor to be located at the building site. Additionally, in order to relocate the building, an owner must employ a construction crew to tear-down the building and prepare it for transportation and reconstruction at the new site.

Accordingly, there is a need for a method for relocatable buildings which provides for a building to be constructed quickly and easily. There is also a need for a method of constructing a relocatable building which can be easily transported by a small group of workers rather than a full construction crew. Further, there is a need for a method of constructing a relocatable building combining the speed and simplicity of construction with quality material which will stand up to the environment for years to come and satisfy applicable building regulations.

SUMMARY OF THE INVENTION

The subject invention pertains to a method for constructing, transporting, and erecting buildings. The subject invention also relates to buildings which can be transported and erected at a desired site. Advantageously, specific embodiments of the subject invention can be relocatable. The subject method can provide for simplified construction of relocatable buildings, such as those used as temporary classrooms or on construction sites. In a specific embodiment the subject invention includes constructing a building section. Each building section can include a floor panel, a wall panel, end panels and roofing structures. The subject invention also provides for the joining of multiple building sections to form larger structures. Additionally, the subject construction method provides for structures which facilitate joining and separating the sections as needed for assembly or movement.

The subject method and apparatus can be used to shorten the time and labor required both to initially construct a building and also to relocate the building as needed. By using the subject invention, those who employ relocatable buildings can move them from site to site with a less labor intensive process than before. The subject relocatable buildings can be relocated with a lifting machine such as a crane and a mode of transport such as a truck.

The subject invention is advantageous in situations where, for example, a school system needs to adapt classroom capacity to the changing population of students within the system. Permanent renovations or additions to school buildings can be expensive and time consuming to implement, but by utilizing the subject relocatable buildings, school systems can shift classroom capacity inexpensively while still maintaining a high quality building for the students to use.

DETAILED DISCLOSURE OF THE INVENTION

The subject invention pertains to a method for constructing, transporting, and erecting buildings. The subject invention also relates to buildings which can be transported and erected at a desired site. Advantageously, a specific embodiment of the subject invention can be relocatable. The subject invention is advantageous in situations where an individual or group, such as a school system or construction company, needs temporary, portable buildings which can easily be constructed and broken down for transportation to a new site. In a specific embodiment, the subject method utilizes durable construction materials to comply with building codes and withstand the rigors of years of service in a variety of environmental conditions in addition to providing rapid construction and relocation benefits.

A preferred method of constructing a building according to the subject invention is now discussed. Most preferably, a building section built according to the subject invention is constructed at a centralized manufacturing site. The individual building sections can then be transported to the installation site where minimal reassembly is required prior to occupancy. A centralized manufacturing site allows for labor usage to be maximized and used more efficiently than constructing each relocatable building at the installation site from the ground up. It is important to note that the specific embodiment described herein relates to a relocatable building consisting of two separable sections which can be broken down and transported. It is understood that a building in accordance with the subject invention can be made from any number, or combination, of sections without deviating from the spirit of the invention.

Figure 1:
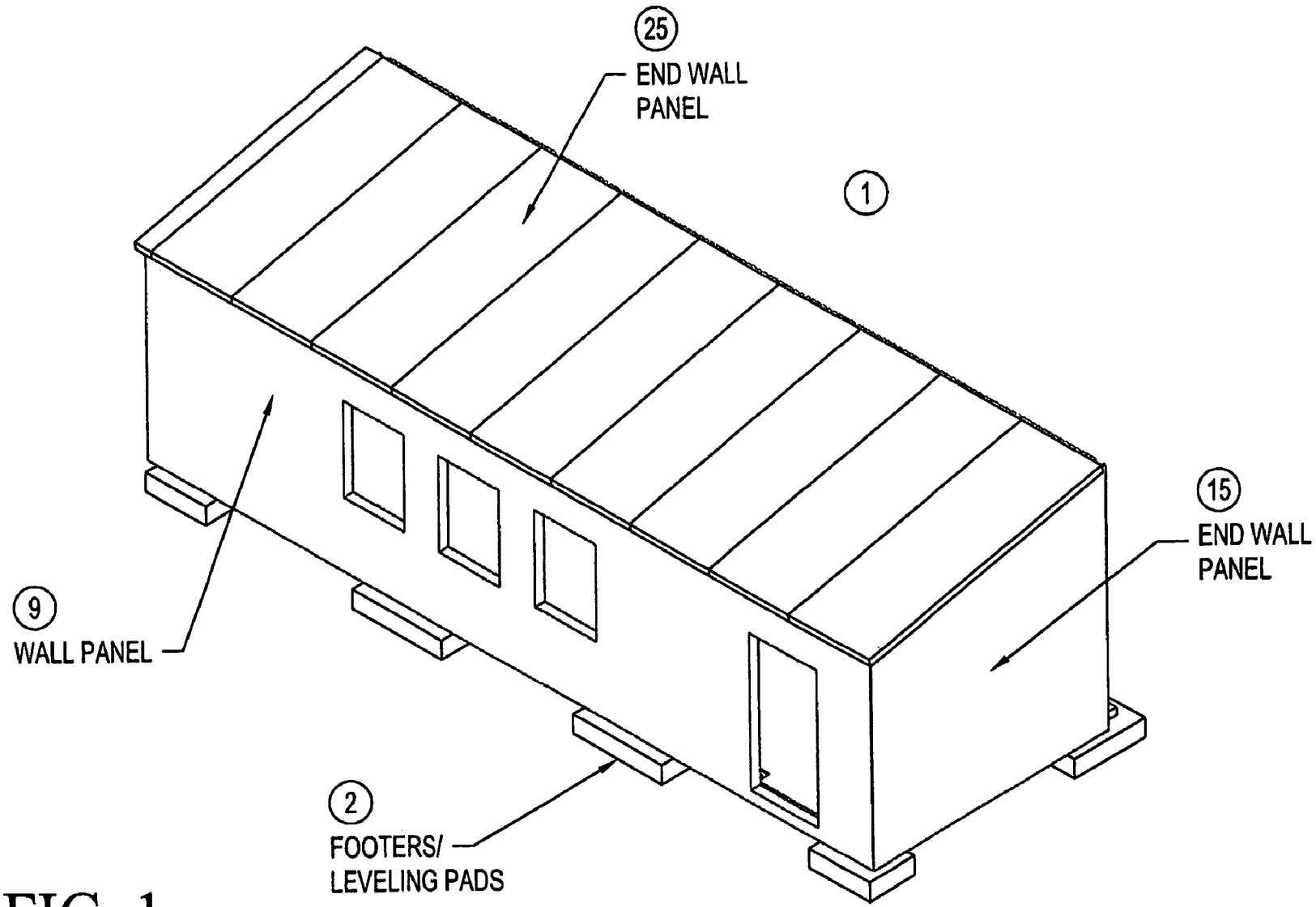
FIG. 1 shows a building section in accordance with a specific embodiment of the subject invention.
Figure 2:
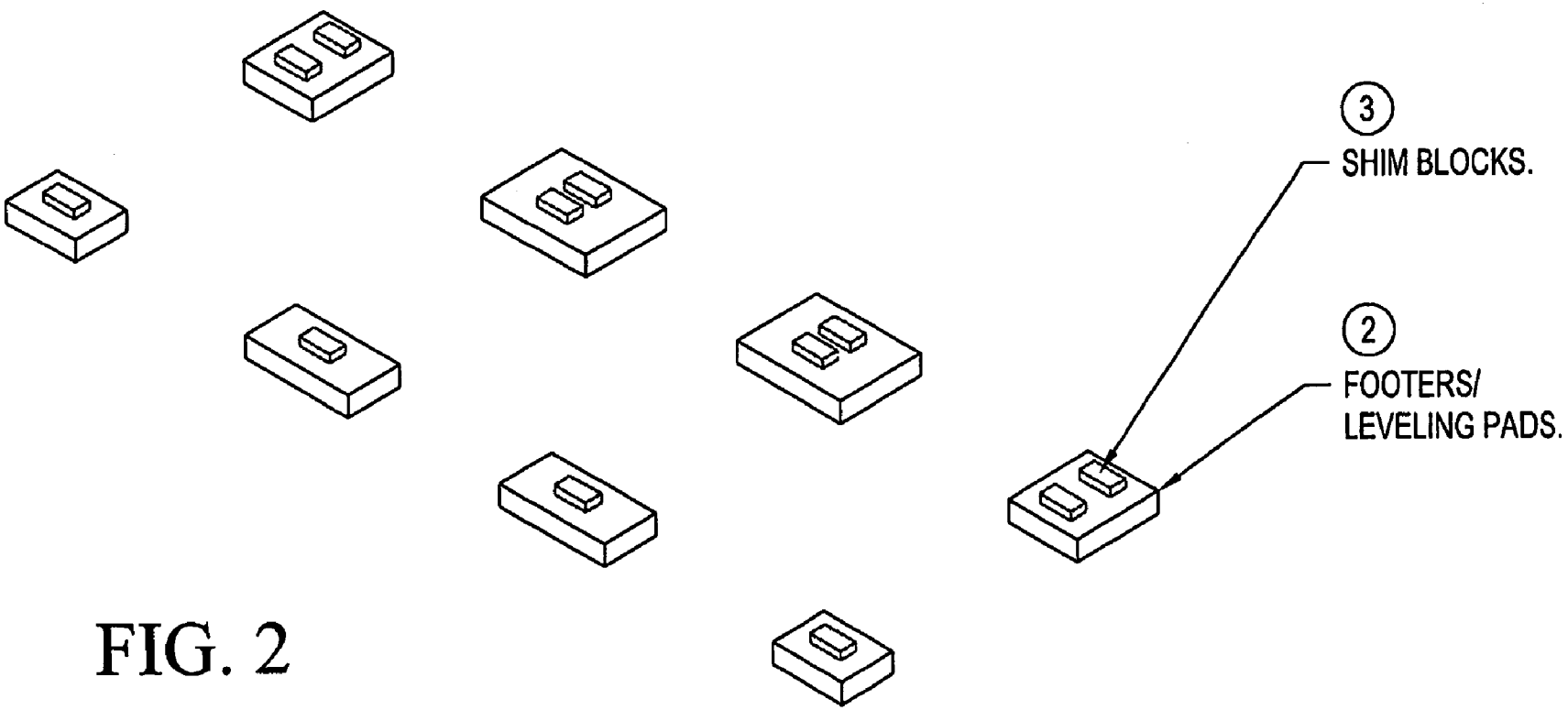
FIG. 2 shows a foundation layout in accordance with a specific embodiment of the subject invention.

FIG. 1 illustrates a building section 1 in accordance with an embodiment of the subject invention. In order to begin construction, the desired building section 1 size and capacity should be determined. Referring to FIG. 2, a preferred first step in construction of a building section 1 is forming a foundation layout 2 of appropriate size. Preferably, the foundation layout is made from concrete high-strength shim blocks 3, but any suitable material such as masonry blocks, wooden blocks or cinder blocks can be used without affecting the functionality of the invention. Alternatively, a foundation layout 2 suitable for construction can be any relatively hard and flat surface, such as packed soil, which is suitable for supporting the weight of the building section. Concrete block-out can be incorporated into the foundation layout 2 for transportation of structure.

Figure 3:
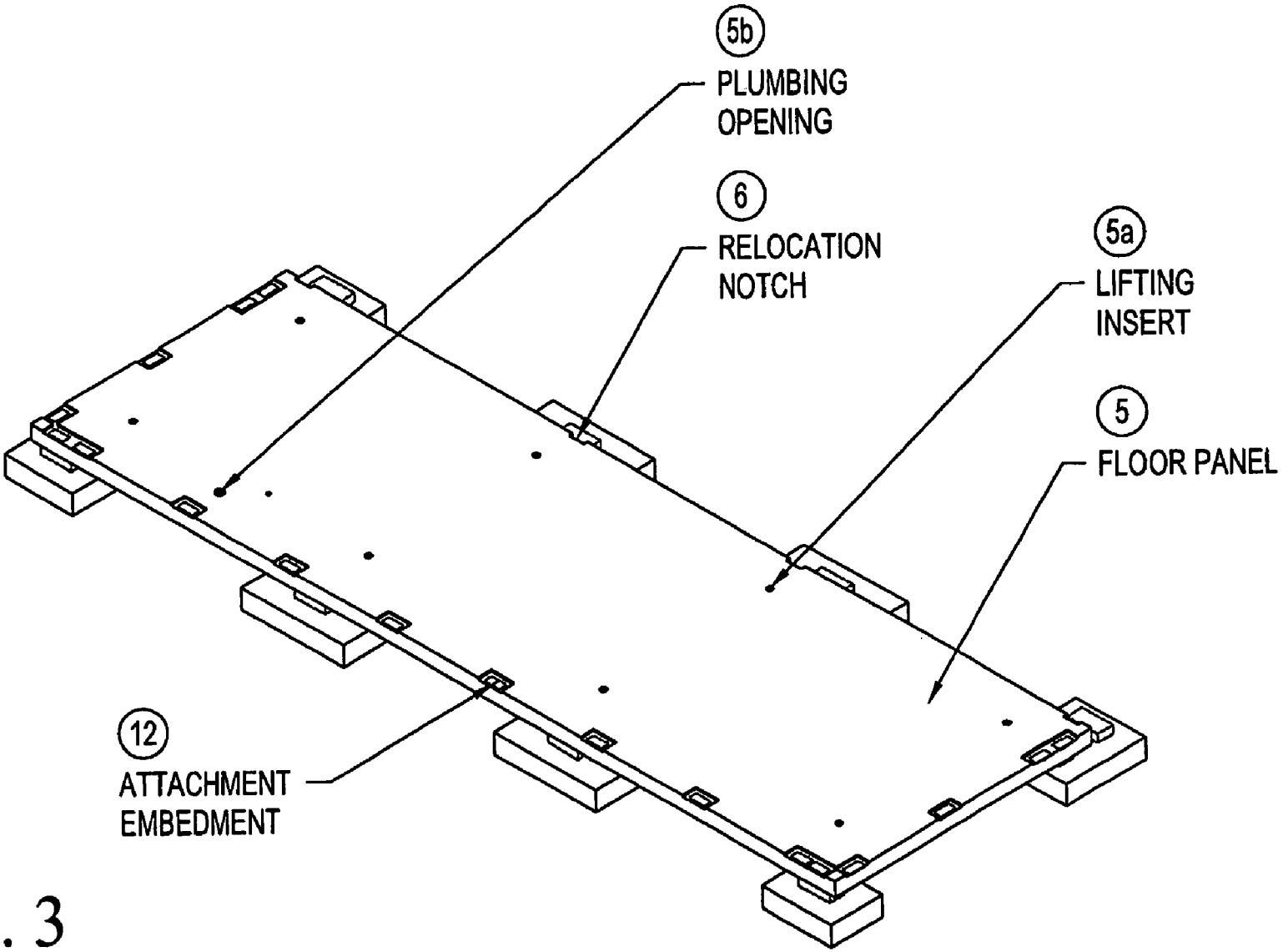
FIG. 3 shows the installation of a floor panel in accordance with a specific embodiment of the subject invention.

Following the construction of the foundation layout 2, a floor panel 5 can be installed onto the foundation layout 2 as illustrated in FIG. 3. If desired, the floor panel 5 can be temporarily secured to the foundation layout 2 for added stability during the construction process. The floor panel 5 can be constructed of any durable material such as poured concrete, plywood, or plastic. Preferably, the floor panel is constructed of 7/1;4" reinforced concrete panels which also have polystyrene insulation embedded during construction. Additionally, relocation notches 6, lifting insert 5*a*, attachment 12, and plumbing opening 5*b* can be incorporated into the floor panel 5 during manufacture.

Figure 4:
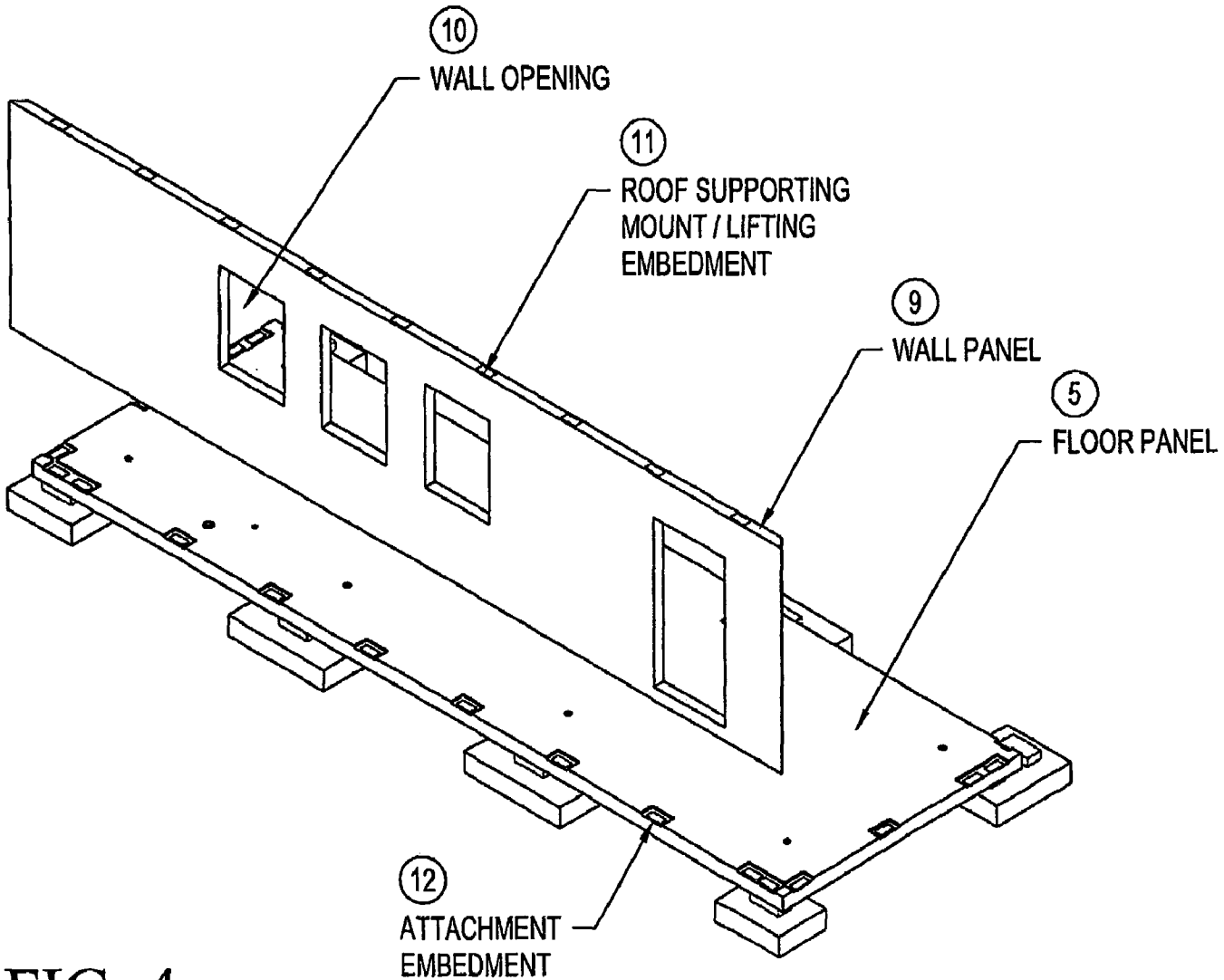
FIG. 4 shows the installation and attachment of a wall panel in accordance with a specific embodiment of the subject invention.

As shown in FIG. 4, a wall panel 9 can be installed following the installation of the floor panel 5. The wall panel 9 can include openings 10 and roof supporting structure mounts/lifting embodiments 11. Openings 10 can be installed for doors, windows, louvers or any other building access commonly needed in buildings of the type being constructed. The roof supporting structures 11 can be used to provide anchoring points for roof supports such as beans, straps or rods. The wall panel 9 is preferably constructed of a strong, durable building material such as poured concrete, wood or plastic. Most preferably, the wall panel 9 is constructed from a reinforced concrete-polystyrene composite, such as INSULWALL™ to provide a greater degree of high wind load resisting weatherproof performance and energy efficiency. The wall panel 9 can be attached to the floor panel 5 through any attachment structure 12 commonly used to join similar building materials such as straps, bolts, or welding. However, the most preferred embodiment uses several welded brackets to attach the wall panel 9 to the floor panel 5. Importantly, relocation bracing points 13 can be embedded in the wall panel 9 to supply anchoring points for aiding in lifting and transporting the building section 1. Installation bracing 9*a* can be installed to support wall panel during installation.

Figure 5:
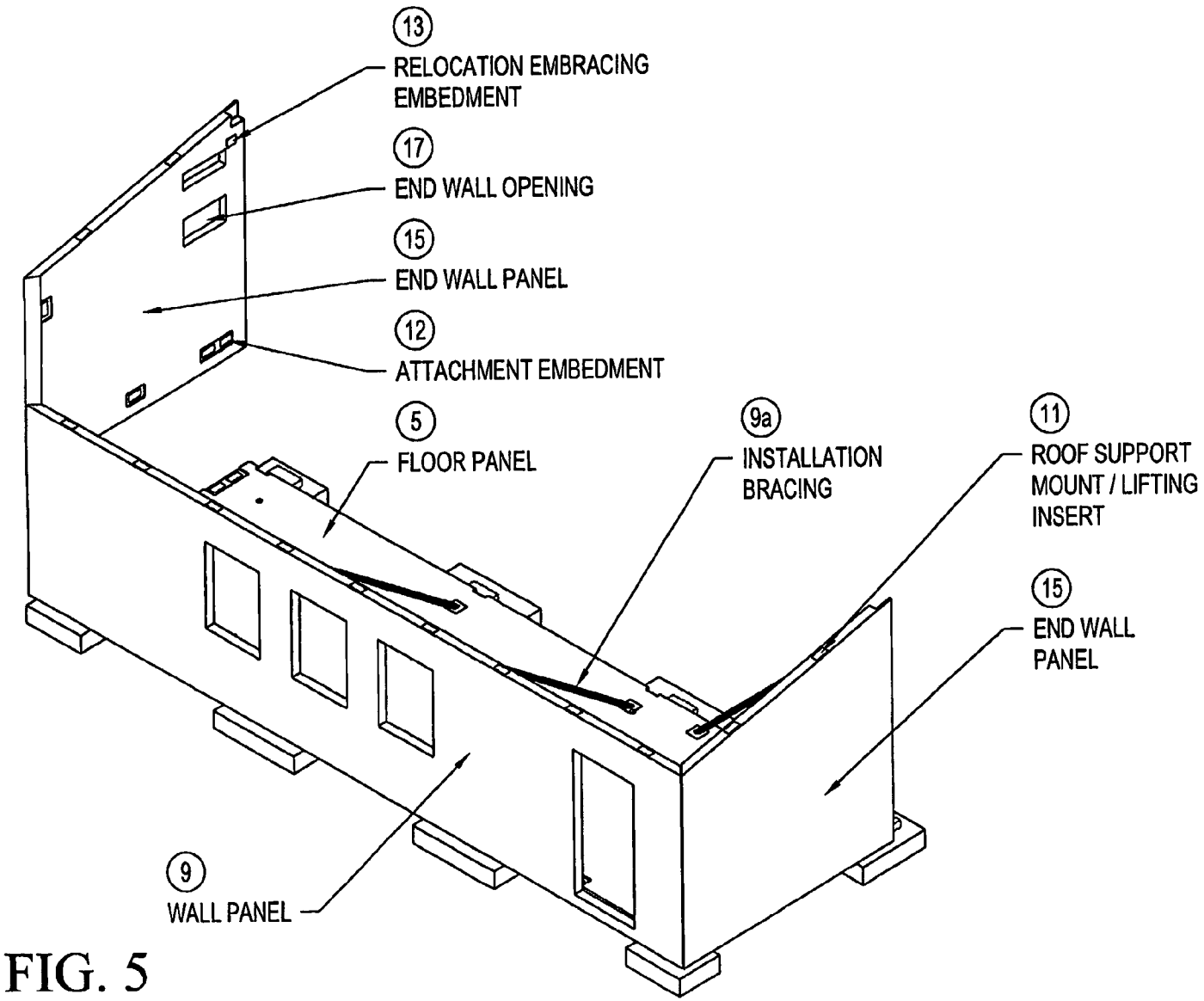
FIG. 5 shows the installation and attachment of end wall panels in accordance with a specific embodiment of the subject invention.

Following installation of the wall panel 9, as shown in FIG. 5, a pair of end panels 15 can be installed and attached to the floor panel 5 and the wall panel 9. End panels 15 can be attached to the floor panel 5 and wall panel 9 in a similar fashion to the attachment previously described in attaching the wall panel 9 to the floor panel 5. End panels 15 can include openings 17 to allow access to the building section 1. Such openings 17 can facilitate, for example, duct installation, venting or electrical access to the building section 1. The end panels 15 can also include relocation bracing points 13 embedded in the end panels 15. The relocation bracing points 13 can provide additional anchoring points for lifting and transporting the building 1. If preferred, end panels 15 can be installed prior to wall panel 9, as would be apparent to one skilled in the art.

Figure 6:
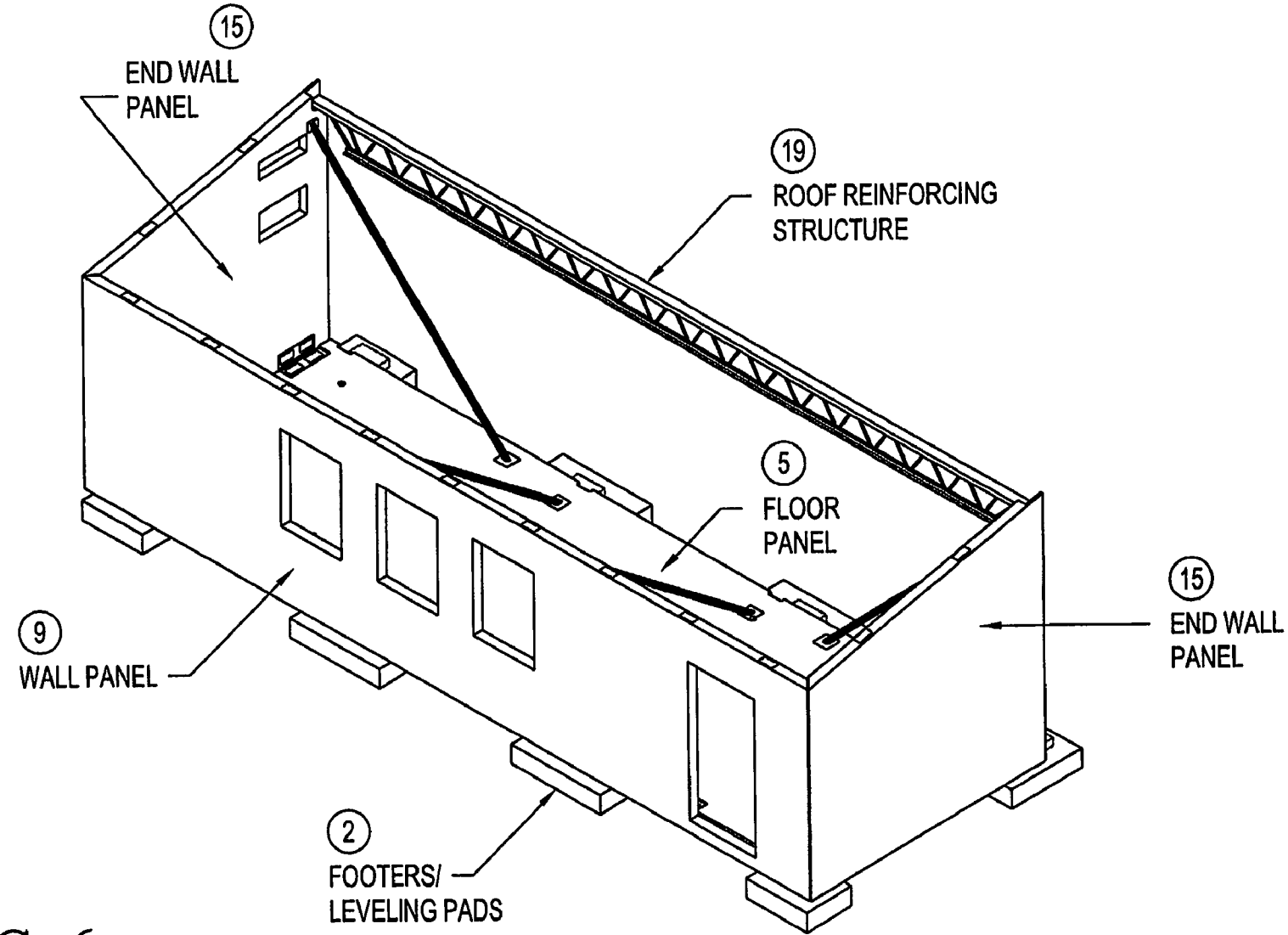
FIG. 6 shows the installation and attachment of a reinforcing structure in accordance with a specific embodiment of the subject invention.

FIG. 6 shows the attachment of a reinforcing structure 19 which can be used to support the roof 25 of the building section 1. The reinforcing structure 19 can take the shape of any suitable structure, such as a bar joist, a truss, steel beam, concrete beam, or wood beam. The reinforcing structure 19 can be made from any suitable material such as steel, wood or plastic and attached to the end panels 15 through suitable attachment methods as previously described. Preferably, the reinforcing structure 19 is made from steel and welded to the end panels 15. Any number of reinforcing structures 19 can be used in construction of the building section 1 without affecting functionality, but preferably there is a floor panel to reinforcing structure ratio of 1:1.

Figure 7:
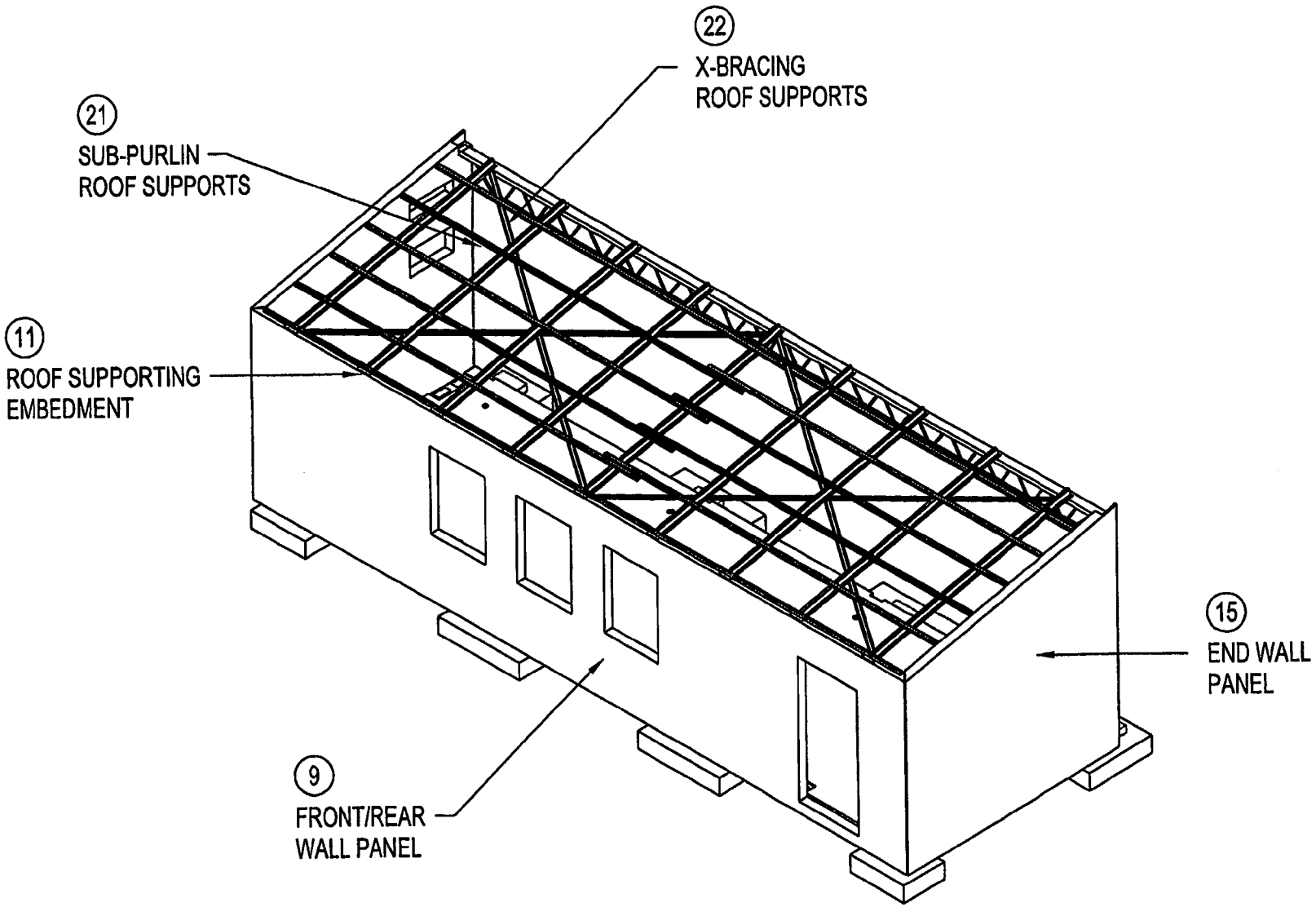
FIG. 7 illustrates the installation of roofing support structures in accordance with a specific embodiment of the subject invention.

FIG. 7 illustrates a building section 1 with sub-purlin roof supports 21 and X-bracing roof supports 22 installed according to a specific embodiment of the subject invention. Such a combination of sub-purlin 21 and X-bracing 22 roof supports can be used to enhance the structural stability of the roof. Roof supports 21 and 22 can be constructed from any suitable material such as steel, plastic or wood. Preferably, sub-purlin roof supports 21 and X-bracing roof supports 22 are made from steel and are secured between either the reinforcing structure 19 and a wall panel 9 or between the reinforcing structure 19 and an end panel 15. When attachments are made to the wall panel 9, the roof supports 21 and 22 can be secured to the roof supporting structure mounts 11 embedded in the wall panel 9.

Figure 8:
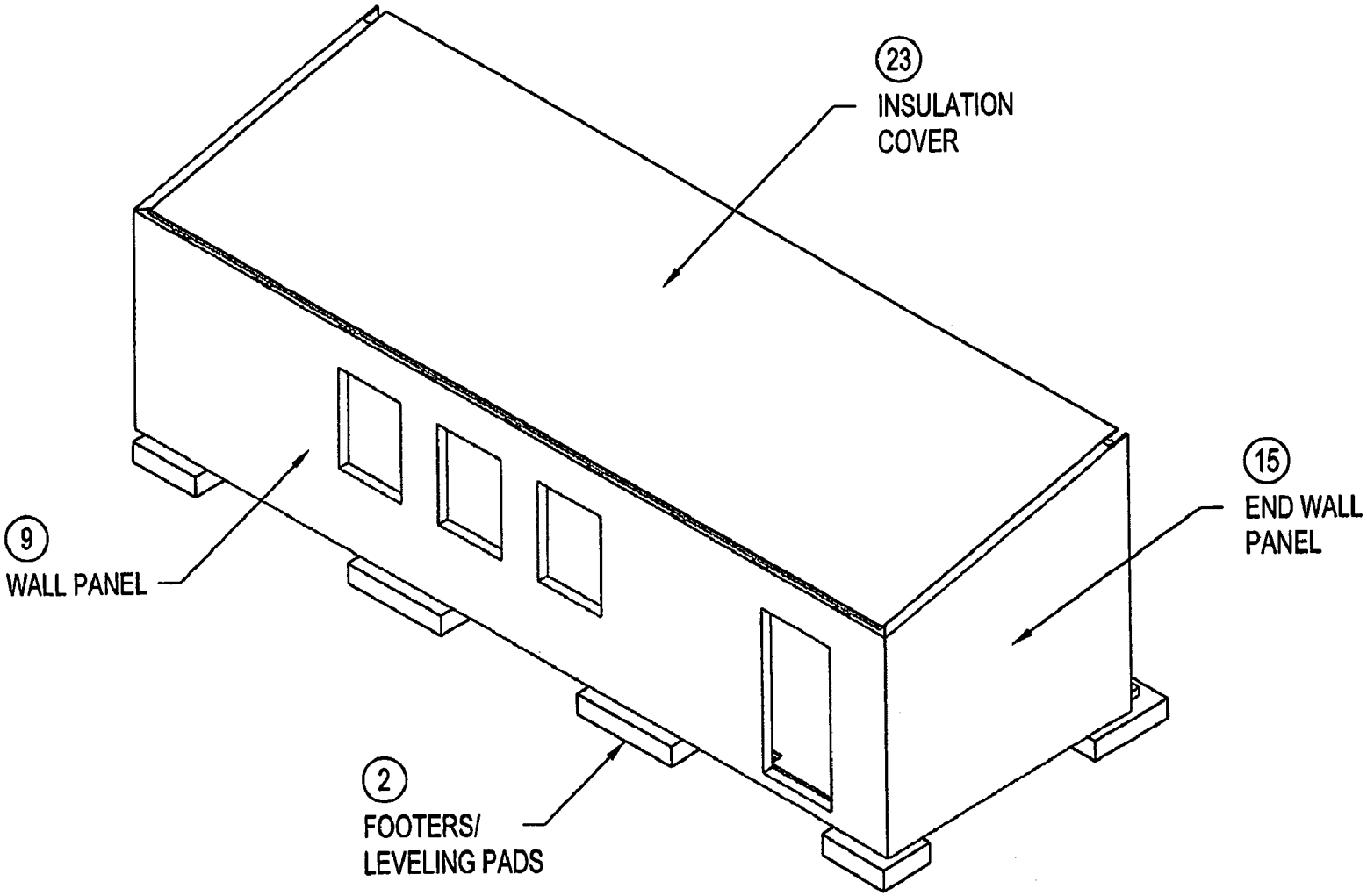
FIG. 8 illustrates the installation of insulating roofing material in accordance with a specific embodiment of the subject invention.

To increase energy efficiency, an insulation cover 23 can be optionally installed over the roof supports 21. FIG. 8 shows a preferred example of a suitable insulation cover 23. The insulation cover 23 can be constructed of any material suitable for building insulation such as polystyrene, vinyl vapor retarder film or vinyl vapor laminate.

Figure 9:
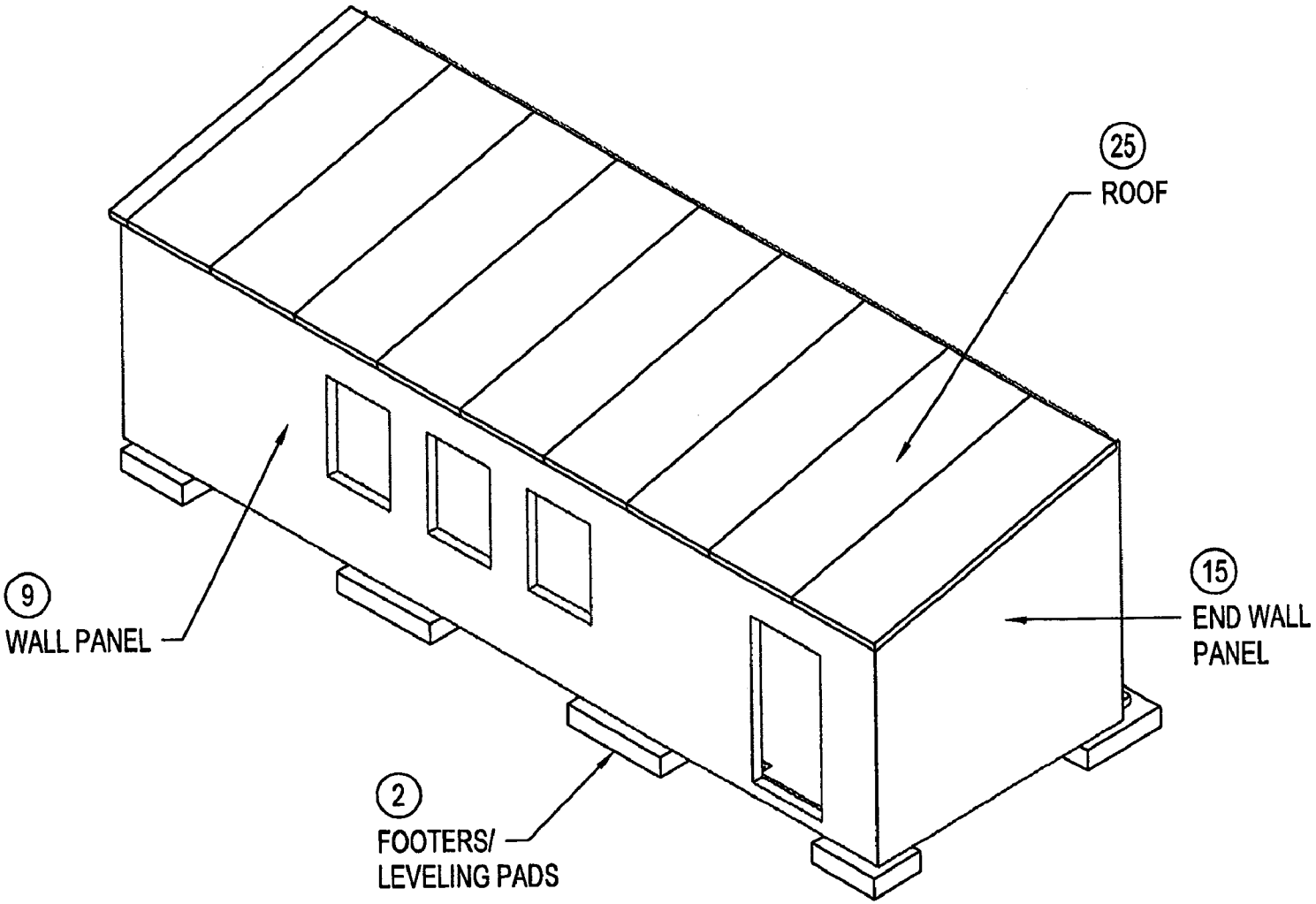
FIG. 9 illustrates an example of a building section with a roof attached in accordance with a specific embodiment of the subject invention.

Once an appropriate insulation cover 23, is installed, the roof 25 can be attached over the building section 1 as shown in FIG. 9. If no insulation cover 23 is utilized, the roof 25 can be installed directly to supports 21 and 22. The roof 25 can be made from any suitable weatherproof roofing material such as reinforced concrete, composite deck, aluminum, steel or traditional shingles.

Thus, a method for constructing a building section 1 according to the subject invention has been described. Additionally, the building section 1 of the subject invention can be prepared for transportation and installation at a new site in a short period of time and without an excess of labor intensive activity.

Figure 10:
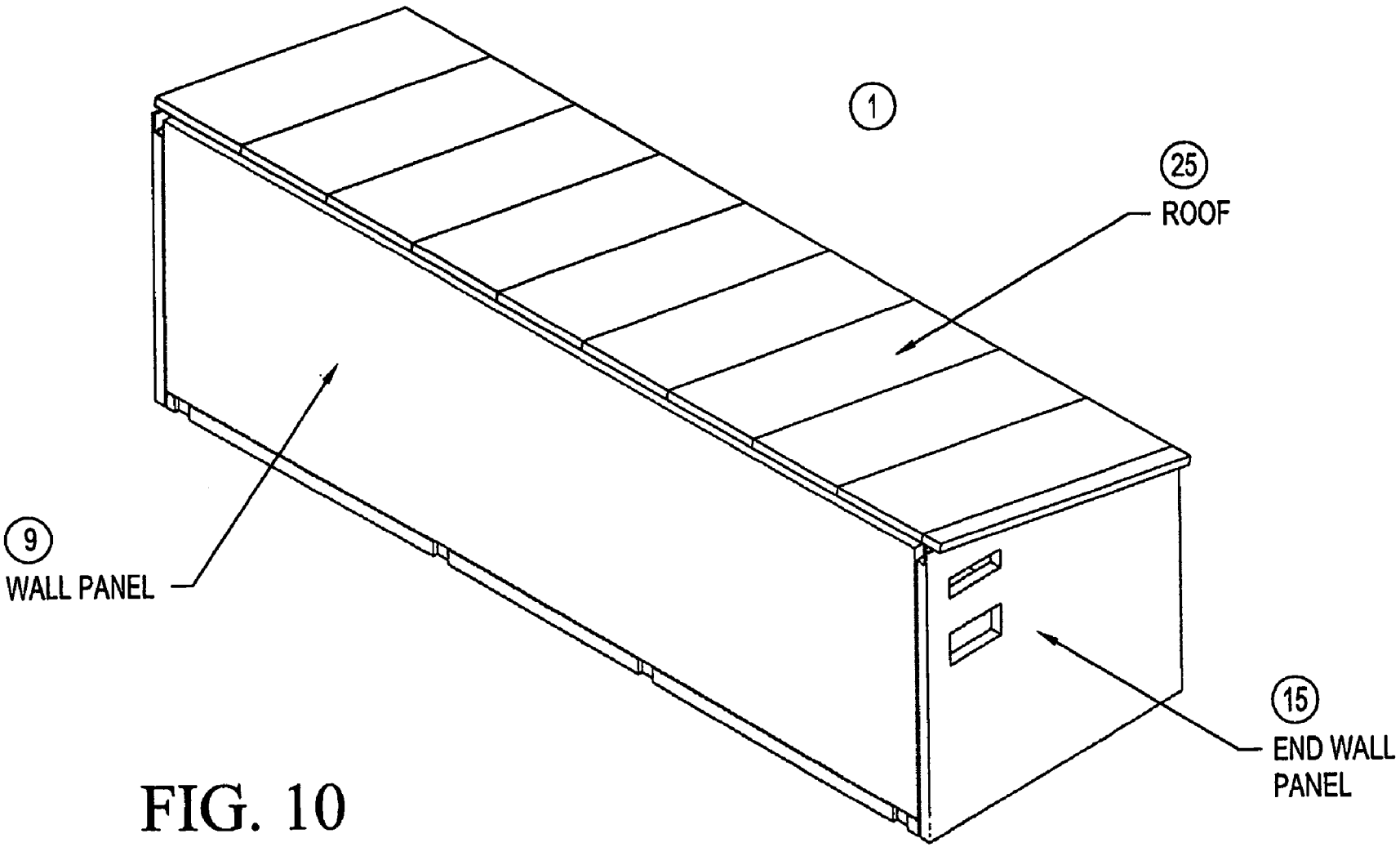
FIG. 10 illustrates a building section in accordance with the subject invention after installation of a second wall panel.

To prepare a building section 1 for occupancy, the present invention provides a wide degree of flexibility of configurations. The uncovered side of the building section 1 can be used to communicate with, for example, another wall panel 9 or another building section 1. In one embodiment, as shown in FIG. 10, a second wall panel 9 can be attached to the floor panel 5, end panels 15 and reinforcing structure 19. The second wall panel 9 can be attached to the floor panel 5, end panels 15 and reinforcing structure 19 in a similar manner as was previously described. In this fashion, a fully enclosed building can be fabricated from a building section 1 through one attachment step. It is understood that the shape and size of the wall panels 9 does not affect the functionality of the subject invention. For example, both wall panels 9 may be of equal size, or, of differing size as illustrated in FIG. 10.

Figure 11:
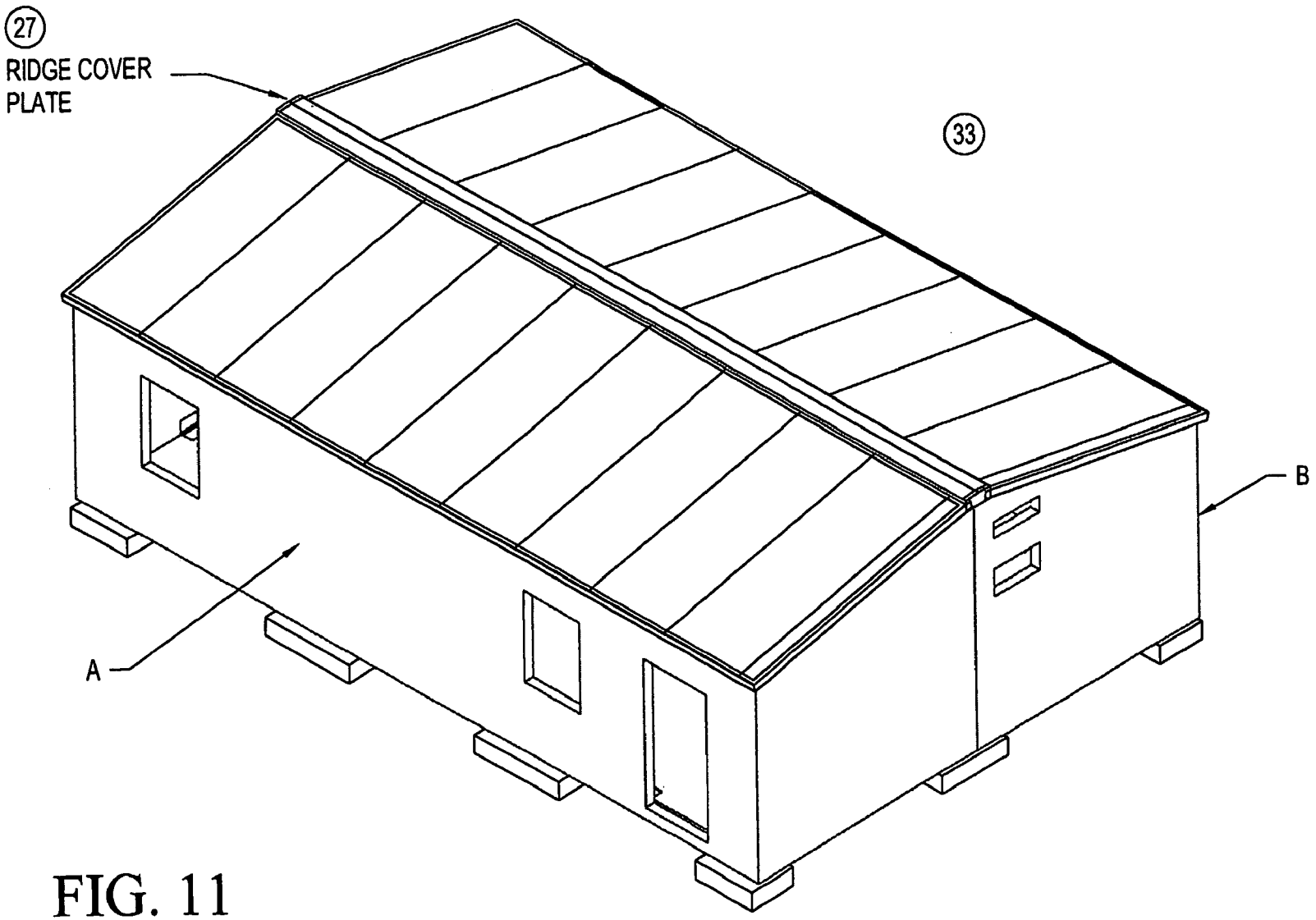
FIG. 11 illustrates the attachment of two building sections to form a building module in accordance with a specific embodiment of the subject invention.

In another specific embodiment, two or more building sections 1 may be combined in order to construct a building module 33 of increased size. For example, as illustrated in FIG. 11, two building sections 1, A and B can be attached to form a building module 33 twice the size of a single building section 1. In order to form a larger building, a corresponding foundation layout 2 is preferably formed in advance. Onto this foundation layout 2 the two building sections A and B can be lowered by a lifting machine, such as a crane. Each individual building section A and B can then be attached to the foundation layout 2 as described in the construction of a building section 1. Each building section A and B can then be attached to each other, floor panel 5 to floor panel 5, end panels 15 to end panels 15. The panel attachment is preferably done through welding, although other means of joining the building sections A and B will be apparent to those skilled in the art. Preferably, after all panels have been attached, a ridge cover plate 27 can be attached across the roof seam, providing a weatherproof barrier. Thus, a larger building module 33 can be constructed from the joining of multiple building sections 1. Alternatively, the construction of a building module 33 can begin with both building sections A and B being constructed simultaneously, in accordance with the methods provided in the subject invention, on a foundation layout 2 of appropriate size.

Figure 12:
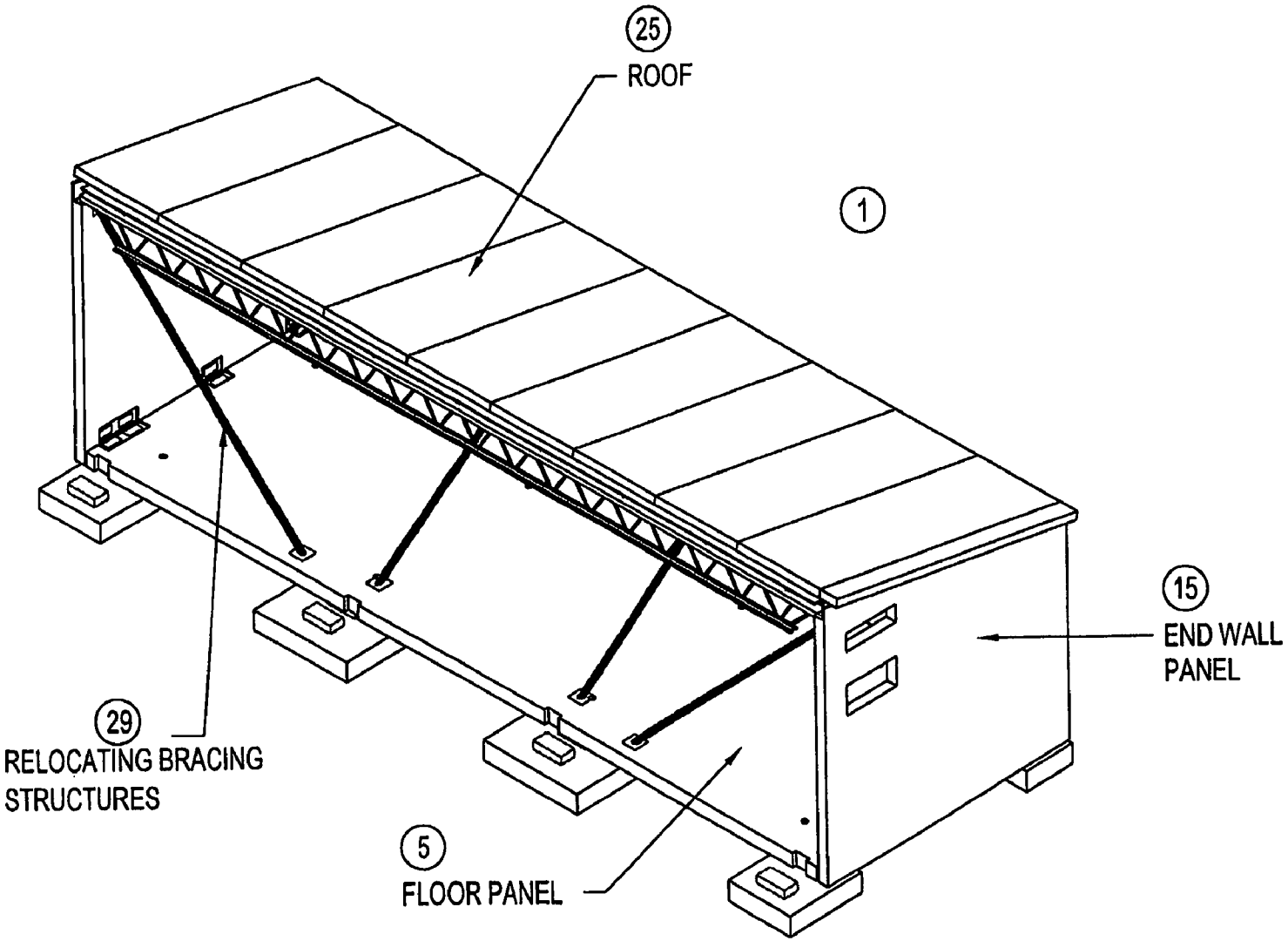
FIG. 12 illustrates the installation of relocation bracing structures in accordance with a specific embodiment of the subject invention.

In order to prepare a building section 1, as shown in FIG. 1, for transportation to a new site, a method of preparing a building section 1 for transportation is also discussed. As shown in FIG. 12, a first step in preparing a building section 1 for transportation is to attach relocation bracing structures 29 to the building section 1 by using the embedded relocation bracing points 13 located in the wall panel 9, floor panel 5 and the end panels 15. The relocation bracing structures 29 can be made of any material suitable to support a building section 1, such as steel or wood. The relocation bracing structures 29 can be attached to the wall panel 9, floor panel 5 and/or end panels 15 through any appropriate attachment means, such as a welding, straps, or bolts. The floor panel 5 is preferably detached from the foundation layout 2 prior to transportation. Thus, as shown in a view of a building section 1 in FIG. 12, a building section 1 has been prepared for transportation by the installation of relocation bracing structures 29.

Figure 13:
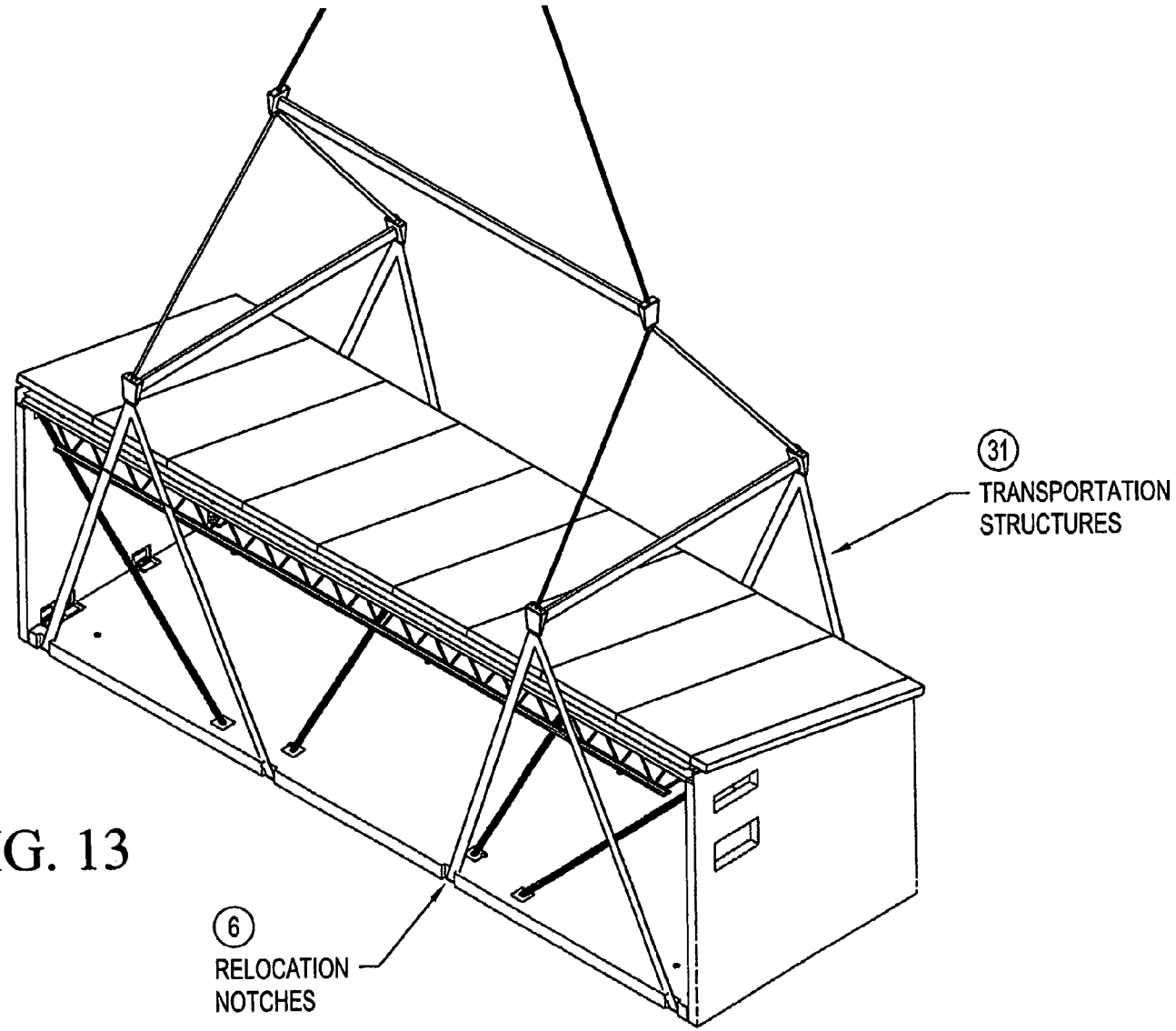
FIG. 13 illustrates the lifting of one building section for transportation in accordance with a specific embodiment of the subject invention.

As shown in FIG. 13, to physically move the building section 1 to another site, transportation structures 31 can be used to lift the building section 1 from the foundation layout 2. The transportation structures 31 can attach to and/or around the floor panel 5 of the building section 1 by means of the relocation notches 6. The transportation structures 31 can be constructed of any material commonly used to lift heavy equipment, such as steel and can include straps, belts or beams. Thus, a crane or any other suitable machine for lifting, can be employed to lift the building section 1 from the foundation layout 2 and onto, for example, an awaiting flat bed truck or train car. The truck or train can then transport the building section 1 to the relocation site for reassembly.

Figure 14:
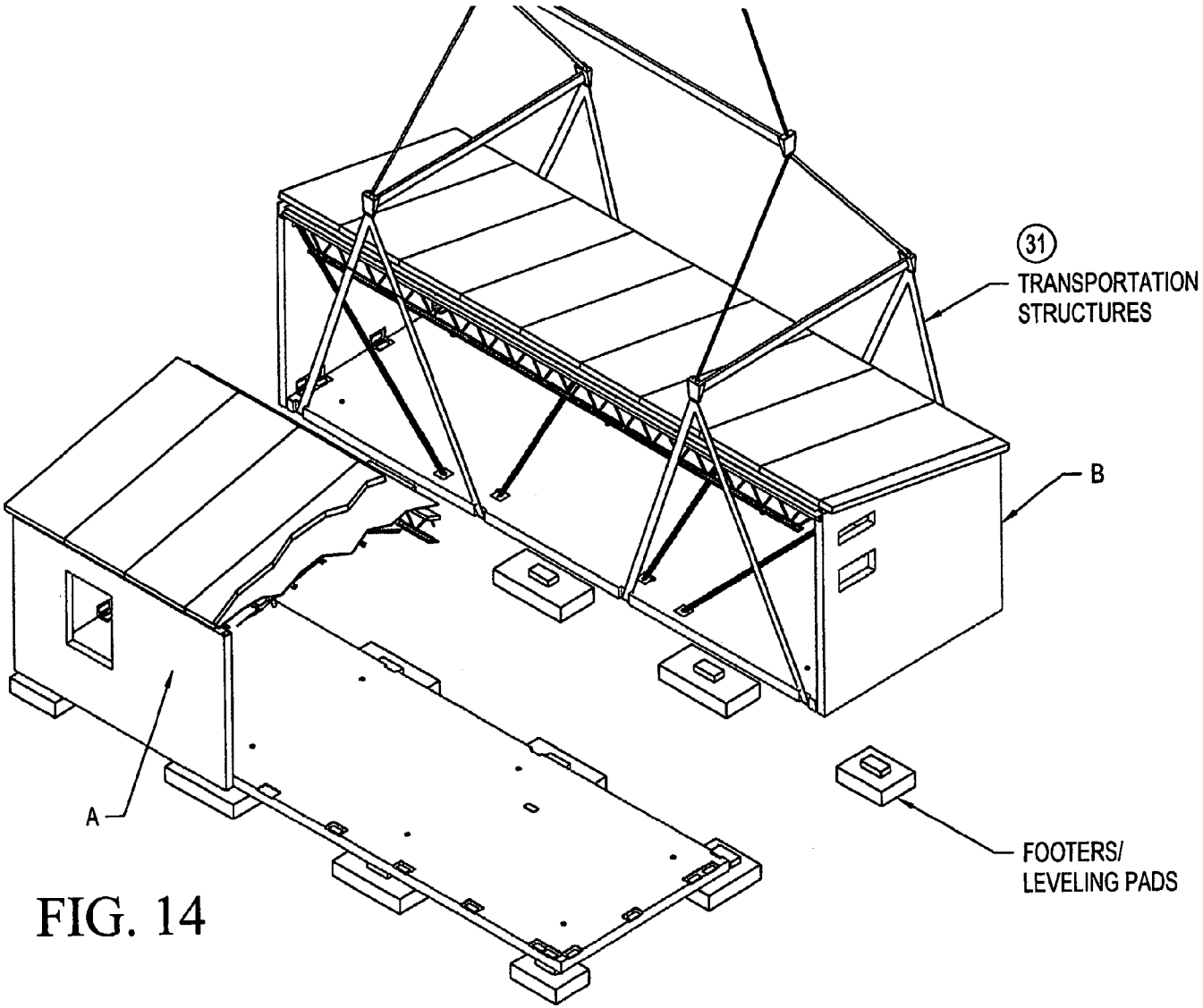
FIG. 14 illustrates the attachment of transportation structures to the relocatable building sections and the lifting of one section for transportation in accordance with a specific embodiment of the subject invention.

When a building module 33 has been constructed, a similar process of transportation preparation can be used. When preparing a building module 33 for transportation, the ridge cover plate 27, if installed, is preferably removed first to ease the separation of the different building sections 1. FIG. 14 shows a building module 33 having building section B being lifted away for relocation while section A is prepared for lifting. In this specific embodiment, once building sections A and B are lifted away, the foundation layout 2 will remain in place. At this point, the foundation layout 2 can be used to construct another building module 33 or can be removed and shipped to the relocation site for installation.

Once the separate building sections A and B arrive at the relocation site, the sections can then be reassembled to prepare the building module 33 for occupancy. The foundation layout 2, generally, although not necessarily, a different foundation layout 2 than the one located at the construction site can be formed. Next, the separate sections A and B can be lowered into place and relocation braces 29 removed. Once the transportation structures 31 and the relocation braces 29 are removed, the ridge cover plate 27 can be reinstalled and the building module 33 is ready to be attached to the foundation layout 2 and for finishing preparations such as carpeting, air conditioning and electricity to be installed prior to occupancy. A similar method can be utilized in installing a single building section 1. The foundation layout 2 corresponding to the building section 1 can be formed and the single building section 1 can be lowered onto the foundation layout 2. The building section 1 can then be attached to the foundation layout 2 and the final wall panel 9 can be secured in place, if not already attached prior to transportation. The finished building can then be prepared for occupancy as described above.

It should be understood that the example and embodiments described herein are for illustrative purposes only and that various modifications or changes in light thereof will be suggested to persons skilled in the art and are to be included within the spirit and purview of this application and the scope of the appended claims.

The invention claimed is:

1. A method for constructing a building section, comprising forming a foundation layout;

positioning a floor panel on said foundation layout;

attaching a wall panel to a first side of said floor panel;

attaching a first end panel to a first end of said floor panel and a second end panel to a second end of said floor panel; and securing each of said end panels to said wall panel;

attaching a reinforcing structure to the first and second end panels rein a first end of said reinforcing structure is attached to said first end panel and a second end of said reinforcing structure is attached to said second end panel;

attaching roof support structures between said reinforcing structure and said wall panel and between said first end panel and said second end panel; and attaching a roof structure to said first end panel, said second end panel, and said wall panel, wherein said building section has an open face defined by said reinforcing structure, sad first end panel, said second end panel, and said floor panel, said building section constructed so that said open face is attachable to a second building section.

2. The method according to claim 1, further comprising attaching said floor panel to said foundation layout.

3. The method according to claim 1, further comprising attaching a second wall panel to a second side of said floor panel, said first end panel, and said second end panel.

4. The method according to claim 1, further comprising attaching a waterproof barrier to said roof support structures.

5. The method according to claim 1, further comprising attaching insulation material underneath said roof structure.

6. The method according to claim 1, wherein said attaching of said wall panel to said first side of said floor panel is performed after attaching said ft end panel to said ft end of said floor panel and said second end panel to said second end of said floor panel and then secured to said first end panel and said second end panel.

7. The method according to claim 1, wherein attaching a first end panel to a first end of said floor panel and a second end panel to a second end of said floor panel is performed after attaching a wall panel to a first side of a floor panel.

8. The method according to claim 1, wherein the floor panel comprises concrete.

9. The method according to claim 1, wherein at least one of the wall panel, the first end panel, and the second end panel comprise concrete.

10. The method according to claim 1, wherein at least one of the wall panel, the first end panel, and the second end panel comprise a reinforced concrete-polystyrene composite.

11. The method according to claim 1, wherein the floor panel comprises relocation notches, wherein the relocation notches allow for attachment of transportation structures upon relocating the floor panel.

12. The method according to claim 1, wherein the floor panel comprises at least one attachment embedment, wherein the wall panel is attached to the floor panel via the at least one attachment embedment.

13. The method according to claim 1, wherein the floor panel comprises at least one floor opening, wherein the at least one floor opening comprises a plumbing opening.

14. The method according to claim 1, wherein the wall panel comprises at least one relocation bracing embedment, further comprising bracing the wall panel to the floor panel with a corresponding at least one installation brace during installation, wherein the corresponding at least one installation brace attaches to the wall panel at the at least one relocation bracing embedment.

15. The method according to claim 1, wherein the wall panel comprises at least one opening for door.

16. The method according to claim 1, wherein the wall panel comprises at least one opening for a window.

17. The method according to claim 1, wherein the wall panel comprises at least one roof supporting mount embedment, wherein the at least one roof supporting mount embedment provides anchoring points for roof supports.

18. The method according to claim 1, wherein attaching a wall panel to a first side of the floor panel comprises welding at least one bracket to the wall panel and to the floor panel.

19. The method according to claim 1, wherein prior to attaching a wall panel to a first side of said floor panel, further comprising:

supporting the wall panel via installation bracing, wherein the installation bracing removeably attach to the wall panel and the floor panel for providing support to the wall panel during installation.

20. The method according to claim 1, wherein prior to attaching a first end panel to a first end of said floor panel and a second end panel to a second end of said floor panel, further comprising:

supporting the first end panel and second end panel via installation bracing, wherein the installation bracing removeably attach to the first end panel and the floor panel and to the second end panel and the floor panel for providing support to the first end panel and second end panel during installation.

21. The method according to claim 1, wherein at least one of the first end panel and the second end panel comprise at least one relocation bracing embedment, further comprising bracing the at least one of the first end panel and the second end panel to the floor panel with a corresponding at least one installation brace during installation, wherein the corresponding at least one installation brace attaches to the at least one of the first end panel and the second end panel at the at least one relocation bracing embedment.

22. The method according to claim 1, wherein at least one of the fist end panel and second end panel comprise at least one wall opening for duct installation.

23. The method according to claim 1, wherein the ratio of floor panel to reinforcing structure is 1:1.

24. The method according to claim 1, wherein the roof support structures comprise sub-purlin roof supports and X-bracing roof supports.

* * * * *

UNITED STATES PATENT AND TRADEMARK OFFICE

CERTIFICATE OF CORRECTION

PATENT NO. : 7,086,209 B1 
APPLICATION NO. : 10/096011
DATED : August 8, 2006
INVENTOR(S) : Richard A. Pruitt and Dennis K. Towell It is certified that error appears in the above-identified patent and that said Letters Patent is hereby corrected as shown below:

Column 1,
Line 45, "and puffing the building" should read --and putting the building--.

Column 3,
Line 63, "constructed of 7/1;4" reinforced concrete" should read --constructed of 7 $^{1}/_{4}$" reinforced concrete--.

Column 4,
Line 4, "mounts/lifting embodiments 11." should read
-- mounts/lifting embodiment 11.--.
Lines 9-10, "beans, straps or rods." should read --beams, straps or rods.--.
Line 24, "to support wall panel" should read --to support wall panels--.

Column 7,
Lines 5-6, "said floor panel; and securing each" should read --said floor panel and securing each--.
Line 9, "end panels rein a first end" should read --end panels, wherein a first end--.
Line 34, "attaching said ft end panel to said ft end of" should read --attaching said first end panel to said first end of--.

Column 8,
Line 50, "of the fist end panel" should read --of the first end panel--.

Signed and Sealed this

Fifth Day of December, 2006

JON W. DUDAS
*Director of the United States Patent and Trademark Office*